US008108947B2

(12) United States Patent
Beauvais

(10) Patent No.: US 8,108,947 B2
(45) Date of Patent: Feb. 7, 2012

(54) PROTECTIVE BODYSUIT

(76) Inventor: Christina Kay Beauvais, Akron, MI (US)

( * ) Notice: Subject to any disclaimer, the term of this patent is extended or adjusted under 35 U.S.C. 154(b) by 60 days.

(21) Appl. No.: 12/853,561

(22) Filed: Aug. 10, 2010

(65) Prior Publication Data

US 2011/0036359 A1 Feb. 17, 2011

Related U.S. Application Data

(60) Provisional application No. 61/273,934, filed on Aug. 11, 2009.

(51) Int. Cl.
*A41B 9/00* (2006.01)

(52) U.S. Cl. ..... 2/78.2; 2/75; 2/80; 2/408; 128/889; 450/102; 450/103; 450/104

(58) Field of Classification Search ..... 2/75, 80, 2/111, 78.2, 400, 404, 407, 408; 128/889; 450/102, 103, 104
See application file for complete search history.

(56) References Cited

U.S. PATENT DOCUMENTS

| | | | | | |
|---|---|---|---|---|---|
| 602,188 | A | * | 4/1898 | Sittig | 2/238 |
| 1,458,547 | A | * | 6/1923 | Rood | 2/78.2 |
| 1,987,369 | A | * | 1/1935 | O'Shea | 602/67 |
| 2,789,290 | A | * | 4/1957 | Mayer | 2/77 |
| 3,140,718 | A | * | 7/1964 | Farkas | 450/103 |
| 3,279,469 | A | * | 10/1966 | Schustack | 450/113 |
| 3,327,707 | A | * | 6/1967 | Storti | 450/115 |
| 3,840,900 | A | * | 10/1974 | Cruz | 2/77 |
| 3,974,836 | A | * | 8/1976 | Carlson | 450/102 |
| 4,280,230 | A | * | 7/1981 | LaFleur | 2/408 |
| 4,371,989 | A | * | 2/1983 | Polsky | 2/227 |
| 4,597,110 | A | * | 7/1986 | Smith et al. | 2/408 |
| 4,604,761 | A | * | 8/1986 | Wright | 2/227 |
| 4,637,078 | A | * | 1/1987 | Southwell | 2/408 |
| 4,835,795 | A | * | 6/1989 | Lonon | 2/408 |
| 4,951,321 | A | * | 8/1990 | Mortensen et al. | 2/408 |
| 4,961,234 | A | * | 10/1990 | Leibman | 2/234 |
| 5,042,092 | A | * | 8/1991 | Ewing | 2/400 |
| 5,194,034 | A | * | 3/1993 | Heppenstall | 446/369 |
| 5,206,957 | A | * | 5/1993 | Gulick | 2/84 |
| D336,355 | S | | 6/1993 | Holton | |
| 5,341,515 | A | * | 8/1994 | Cohen | 2/400 |
| 5,367,709 | A | * | 11/1994 | Teasley | 2/69 |
| 5,535,452 | A | * | 7/1996 | Rozenblat | 2/403 |
| 5,636,387 | A | * | 6/1997 | Lundy | 2/408 |
| 5,822,793 | A | * | 10/1998 | Tokura et al. | 2/69 |
| 5,896,581 | A | * | 4/1999 | Wong | 2/78.2 |
| 5,930,838 | A | * | 8/1999 | Carter-Scott-Pomije | 2/79 |
| 6,035,439 | A | * | 3/2000 | Chin | 2/67 |
| 6,102,899 | A | * | 8/2000 | Yimin | 604/385.01 |

(Continued)

OTHER PUBLICATIONS

Beauvais, Christina, "Protective Undergarment", Expired Provisional Patent Application, U.S. Appl. No. 61/190,704, filed Sep. 2, 2008.

(Continued)

*Primary Examiner* — Gary L Welch
*Assistant Examiner* — Andrew W Collins

(57) ABSTRACT

The invention is for a bodysuit for clothing of a human to assist in comfortable wearing of an orthotic brace. Trouserette sections, an elliptical sanitary voiding aperture, and a loincloth with a pelvic girdle flap elongated end releasably joined to a body sleeve provide the wearer with comfort, modesty, and convenience in sanitary voiding. Stretch cotton/spandex knit cloth, externally overlocked seaming, coverstitched stitches, flat zigzag stitchery, and hook and loop tape fasteners enhance quality and comfort in various embodiments.

13 Claims, 8 Drawing Sheets

U.S. PATENT DOCUMENTS

| | | | | |
|---|---|---|---|---|
| 6,243,871 | B1 * | 6/2001 | Fidler | 2/80 |
| 6,308,341 | B1 * | 10/2001 | Shelton | 2/400 |
| 6,324,699 | B1 * | 12/2001 | Cosmah | 2/239 |
| 6,364,851 | B1 | 4/2002 | Nafpliotis | |
| 6,374,412 | B1 * | 4/2002 | Canlas | 2/67 |
| 6,412,119 | B1 * | 7/2002 | Robles | 2/400 |
| D464,789 | S | 10/2002 | Varon | |
| 6,964,065 | B2 * | 11/2005 | Stevenson | 2/400 |
| 7,318,240 | B1 | 1/2008 | Rendone | |
| 7,908,671 | B2 * | 3/2011 | Gaugler et al. | 2/69.5 |
| 2002/0062511 | A1 * | 5/2002 | Lee | 2/78.2 |
| 2002/0088046 | A1 * | 7/2002 | Fidler | 2/80 |
| 2003/0024028 | A1 | 2/2003 | Sleeson | |
| 2005/0223467 | A1 * | 10/2005 | Cardarelli et al. | 2/111 |
| 2006/0000478 | A1 | 1/2006 | Taylor | |
| 2006/0037123 | A1 | 2/2006 | Green | |
| 2006/0191059 | A1 * | 8/2006 | Smith | 2/400 |
| 2006/0286900 | A1 * | 12/2006 | Zarabi | 450/22 |
| 2007/0056076 | A1 | 3/2007 | Gaugler et al. | |

OTHER PUBLICATIONS

Beauvais, Christina, "Protective Undergarment", Pending Provisional Patent Application, U.S. Appl. No. 61/273,934, filed Aug. 11, 2009.

* cited by examiner

PROTECTIVE BODYSUIT

CROSS-REFERENCE TO OTHER APPLICATIONS

This application claims benefit under 35 U.S.C. §119(e) of U.S. Provisional Patent Application 61/273,934 as filed on Aug. 11, 2009.

INTRODUCTION

This invention provides a garment for protecting a wearer's skin from uncomfortable chafing from another item, such as an orthotic brace.

Comprehensive protective undergarments, or bodysuit garments, have been used in the fashion industry as stylish and functional lingerie (U.S. Pat. No. 7,318,240, US Patent Application 2006003712). They have also been used to minimize discomfort from orthotic braces (US Patent Application 20030024028, U.S. patent D336,355). However, many conventional bodysuits do not allow for elimination of wastes while wearing an orthotic brace over the top of them. This presents a challenge for children and young adults who must wear such a brace when attending school and who therefore need to use washroom facilities independently during the school day. In this regard, it is desirable for the wearer to eliminate wastes without having to remove a brace, such as a scoliosis brace. Snap closure or hook and loop closure pelvic girdles exist in infant and toddler clothing (US Patent Application 20070056076, U.S. patent D464789) and effectively address the need for efficient diaper changes in young children. However, such garments are not designed to address the need for protection between the skin and an orthotic brace. Close-fitting bodysuits also exist for other therapeutic use, such as use with biomechanical therapies (US Patent Application 20060000478), but do not appear to comprehensively address the full set of comfort needs of the orthotic brace wearer; such needs include seams that won't press into the skin under pressure of a tight-fitting brace, and appropriate extension of the bodysuit onto the leg to preclude chaffing and irritation from leg straps. Clearly the need exists for a one-piece protective garment that provides the wearer with comfortable support under an orthotic brace, attached garment "legs" (trouserette sections) to prevent chafing and discomfort from braces having leg straps, and a convenient way for managing sanitary voiding. The protective garment also needs to provide for mental comfort respective to modesty, and it also needs to facilitate ability to promptly use school sanitary facilities. The described embodiments of the invention provide such a balance in enabling physical comfort, convenient sanitary voiding, and emotional comfort respective to modesty for the wearer of a bodysuit in use of an orthotic brace.

SUMMARY

The invention is for a bodysuit for a human. The bodysuit is appreciated as it relates to the human's neck, anterior body surface, posterior body surface, groin, torso between the neck and the groin, buttocks at a lower posterior portion of the torso, and legs (first leg and second leg). For geometric orientation in a standing person, a vertical body axis is defined as extending from the groin to the neck, a horizontal body axis is defined to be perpendicular to the vertical body axis at an upper extremity of the buttocks and disposed in a transverse plane dividing the posterior body surface from the anterior body surface, and a mesial plane is also defined containing the vertical body axis and perpendicular to the horizontal body axis. The bodysuit has:

a body sleeve with a first trouserette section for lightly compressing against the upper portion of the first leg, a second trouserette section for lightly compressing against the upper portion of the second leg, an inner posterior body sleeve surface for lightly compressing against the posterior body surface, an outer anterior body sleeve surface where the body sleeve clothes the anterior body surface, a voiding aperture defined in the body sleeve by a closed perimeter having sufficient circumference for enabling sanitary voiding, and a first fastening component affixed to the outer anterior body sleeve surface at a fastening location; and a loincloth with an upper edge permanently attached to the inner posterior body sleeve surface and also with a second fastening component positioned for releasable joinder to the first fastening component.

The closed perimeter is essentially elliptical in form, is symmetrical about the mesial plane, and has an elongated curvilinear axis that, in use, is generally contained in the mesial plane and is shaped to continuously contour along the buttocks, the groin, and a lower portion of the anterior body surface. The upper edge of the loincloth has a first end and a second end, and is evenly attached to the inner posterior body sleeve surface from the first end to the second end. The upper edge is positioned to be, in use, proximate to the horizontal axis such that the upper edge essentially traverses completely across the inner posterior body sleeve surface perpendicularly through the mesial plane. The loincloth is symmetrical with respect to the mesial plane, is disposed in non-voiding use to smoothly shape along the groin and surfaces of the torso, and is dimensioned such that, in non-voiding use, the flap bears against the buttocks and has side edges that respectively converge from the first and second ends such that the flap essentially covers the buttocks, traverses through the aperture, extends therefrom to provide an elongated end portion fully covering the groin and the anterior body surface at locations within the voiding aperture, and further extends therefrom to the fastening location such that the second fastening component is positioned for releasable joinder to the first fastening component, and such that the loincloth can be released from the first fastening component and pulled posteriorly to enable sanitary voiding through the aperture.

In one embodiment, one side edge of the side edges is permanently attached to the inside body sleeve surface from the first end to a first side edge interim location (situated about halfway between the groin and the first end), and the other side edge of the side edges is permanently attached to the inside body sleeve surface from the second end to a second side edge interim location (situated about halfway between the groin and the second end).

In various embodiments, the first and second fastening components are provided with hook and loop tape.

In various embodiments, the bodysuit is primarily constructed of stretch cotton/spandex knit cloth.

In various embodiments, the body sleeve has two arm sleeves.

In various embodiments, the body sleeve employs the use of at least one externally overlocked seam.

In various embodiments, any of the arm-hole edges, neck-hole edge, and leg-hole edges of the bodysuit are finished with coverstitched stitches.

In one embodiment, the fastening components are achieved with an elongated hook and loop tape component disposed vertically so that the loincloth can be attached to provide comfortable compression against the groin.

In various embodiments, the upper edge is permanently evenly attached to the inside body sleeve surface with a flat zigzag stitch.

In various embodiments, the upper edge and attached portions of the first side edge and the second side edge are all permanently attached to the inside body sleeve surface with a flat zigzag stitch.

In one embodiment, the first side edge is parallel to the mesial plane from the first end to the first side edge interim location, and the second side edge is parallel to the mesial plane from the second end to the second side edge interim location.

Further areas of applicability will become apparent from the detailed description provided hereinafter. It should be understood that the detailed description and specific examples, while indicating embodiments of the invention, are intended for purposes of illustration only and are not intended to limit the scope of the invention.

BRIEF DESCRIPTION OF THE DRAWINGS

The present invention will become more fully understood from the detailed description and the accompanying drawings of FIGS. 1 to 8.

Figure 1:
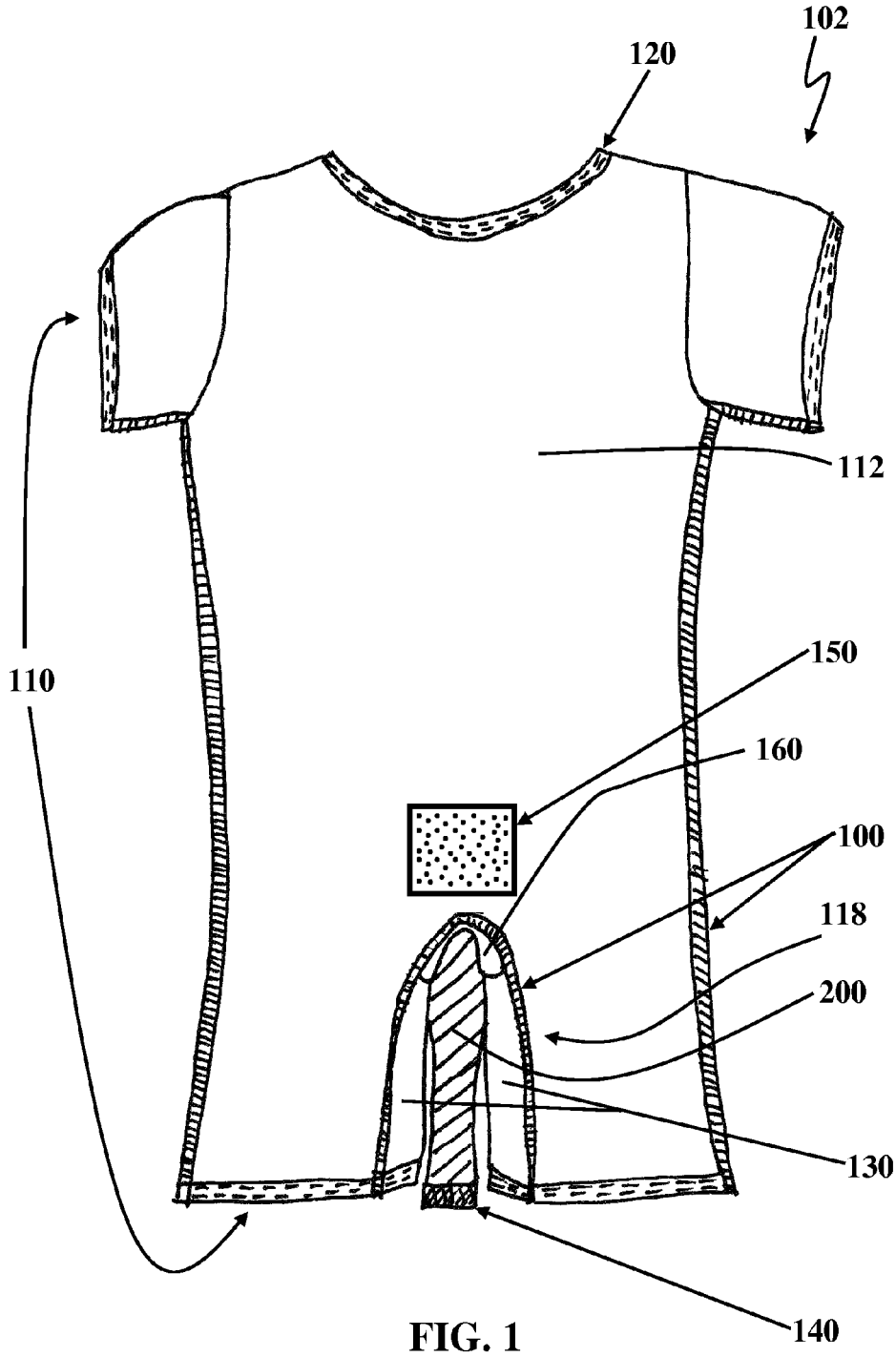
FIG. 1 provides an anterior view of a protective bodysuit when the bodysuit is open at the pelvic girdle area.

It should be noted that the figures set forth herein are intended to exemplify the general characteristics of an apparatus, materials, and methods among those of this invention, for the purpose of the description of such embodiments herein. The figures may not precisely reflect the characteristics of any given embodiment, and are not necessarily intended to define or limit specific embodiments within the scope of this invention.

DESCRIPTION OF PREFERRED EMBODIMENTS

Preferred embodiments will now be discussed in more detail, in conjunction with the accompanying drawings.

The following definitions and non-limiting guidelines must be considered in reviewing the description of this invention set forth herein.

The headings (such as "Introduction" and "Summary") and sub-headings (such as "Amplification") used herein are intended only for general organization of topics within the disclosure of the invention, and are not intended to limit the disclosure of the invention or any aspect thereof. In particular, subject matter disclosed in the "Introduction" may include aspects of technology within the scope of the invention, and may not constitute a recitation of prior art. Subject matter disclosed in the "Summary" is not an exhaustive or complete disclosure of the entire scope of the invention or any embodiments thereof.

The citation of references herein does not constitute an admission that those references are prior art or have any relevance to the patentability of the invention disclosed herein. All references cited in the Description section of this specification are hereby incorporated by reference in their entirety.

The description and specific examples, while indicating embodiments of the invention, are intended for purposes of illustration only and are not intended to limit the scope of the invention. Moreover, recitation of multiple embodiments having stated features is not intended to exclude other embodiments having additional features, or other embodiments incorporating different combinations of the stated features.

As used herein, the words "preferred" and "preferably" refer to embodiments of the invention that afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein, the word "include," and its variants, is intended to be non-limiting, such that recitation of items in a list is not to the exclusion of other like items that may also be useful in the materials, compositions, devices, and methods of this invention.

The embodiments describe assemblies and manufactured items that enable benefits of orthotic bracing to be fully exploited.

The examples and other embodiments described herein are exemplary and not intended to be limiting in describing the full scope of compositions and methods of this invention. Equivalent changes, modifications and variations of specific embodiments, materials, compositions and methods may be made within the scope of the present invention, with substantially similar results.

The embodiments relate to protective bodysuits (garments) where some embodiments provide a barrier between an orthotic brace and the wearer's chest, shoulders, upper arms, back, abdominal, and upper thigh areas as needed. In one embodiment, a front (anterior) portion (covering the chest, abdominal, and front thigh regions), a back (posterior) portion (covering the back, buttock, and hamstring areas), two arm parts (covering the shoulders and upper arms), and two inner thigh components (connecting the front and back portions at the inner leg areas) are first sewn together to provide a body sleeve component. The front and rear portions, inner thigh portions, and arm portions are all made of stretch cotton knit cloth such as cotton/spandex blend material; an example of such a cotton/spandex blend material is White 92% organic cotton/8% spandex material as woven and distributed by Green Castle Textile of Los Angeles, Calif. The front and back portions are connected to each other with two external side seams and to the inner thigh portions with two external seams.

This posterior lined portion of the full bodysuit is achieved using a loincloth (in one embodiment of the same stretch cotton knit material as used for the body sleeve) attached to the body sleeve; the loincloth has a portion denoted as an elongated pelvic girdle flap that wraps from the back to front of the wearer and attaches with hook-and-loop closure at the front of the pelvis. The front, back, and inner thigh portions are stitched with overlocked seams (that are disposed externally on the outside of the garment rather than against the skin of the wearer on the inside of the garment). The arm-hole edges, neck-hole edges, and leg-hole edges are finished in one embodiment with a coverstitched finished stitch, with the neck-hole preferably reinforced with clear elastic for extra durability. Alternatively in another embodiment, the neck is finished with a zigzag stitch. The area just above the pelvis has one hook and loop tape measuring about 2 inches by about 2 inches (or, alternatively, approximately about 2 inches in the vertical direction by about 3 inches wide) attached vertically at the front (external body suit surface) of the lower front portion of the anterior side of the body suit, and a mating hook and loop closure attached horizontally near the end of the pelvic girdle flap. The mating hook and loop closure is sized to be about ¾" inch by about 2 inches, or, alternatively as reflecting either physical size or personal preference of the wearer, about ¾" inch by about 3 inches. The pelvic girdle flap portion of the loincloth wraps around and attaches at various places (higher or lower in the joining area of the hook and loop closure components) using the vertical hook and loop closures to commensurately provide for more or less "room" in the pelvic girdle area respective to immediate comfort needs. The loincloth "lining" is also attached in the lined portion of the bodysuit with a flat zigzag stitch across the top and partway down to the groin in the lower buttock region, facilitating stretching for sanitary voiding through the opening (voiding aperture) in the "outer" layer of the bodysuit. Coverstitching in the above is achieved, for example, with a coverstitch machine such as a Janome CoverPro Model 900CP brand sewing machine as available from Janome America, Inc. of 10 Industrial Avenue, Mahwah, N.J.; overlocked seams in the above is achieved, for example, with a machine such as a Pfaff Hobbylock Model 786 brand sewing machine as available from Pfaff USA, Inc. of 31000 Viking Parkway, Westlake, Ohio. In use, the pelvic girdle flap portion easily opens and closes, allowing the wearer both enough room to eliminate wastes in a sanitary manner and enough hook and loop closure area to allow for adjusting compression of the pelvic girdle flap portion comfortably against groin 514 when secured.

Figure 2:
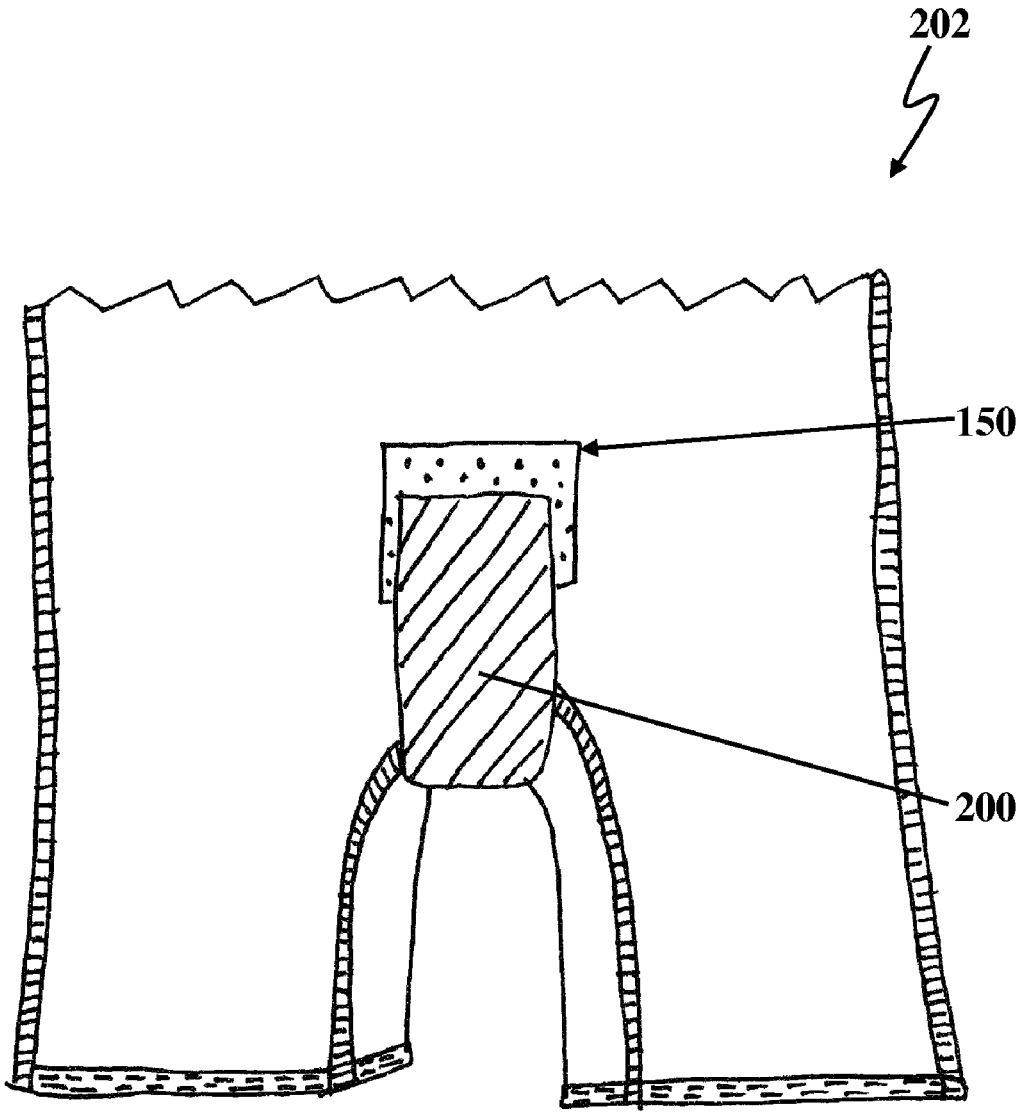
FIG. 2 provides an anterior view of a protective bodysuit when the bodysuit is closed at the pelvic girdle area.

FIGS. 1 and 2 present front views 102, 202 of a bodysuit (garment) 112. FIG. 1 shows overall anterior view 102 of garment 112 unfastened in pelvic girdle area 118, to allow for waste elimination, and FIG. 2 presents lower anterior view 202 of garment 112 having pelvic girdle flap 200 of loincloth 350 (see FIG. 3) fastened as it would be during normal (non-voiding) activity of the wearer. FIG. 1 also shows external seams 100 (seams located on the outside of garment 112) located on both sides and both inner thigh regions of garment 112. FIG. 1 also shows inner thigh garment portions 130 of the garment (inner thigh garment portions 130 of trouserette sections 614*a*, 614*b*—see FIG. 6). In one embodiment, overlocked seams of nylon/stretch thread are used for stitching seams 100; such stitching is executed with an overlock (serger) type sewing machine (such as the Pfaff Hobbylock Model 786 as previously described) rather than with a traditional sewing machine. Care and attention in establishing a balance between thread tension and stitch length enables the fabric of garment 112 to stretch at seams 100 and other edges (such as at arm and leg openings 110) without breaking the seam. As should be apparent, relevant sewing machine settings vary depending on the sewing machine and serger used. FIG. 1 also shows edges (preferably coverstitched finished) at arm and leg openings 110. FIG. 1 also shows a neck seam 120, that, in a preferred embodiment, is finished as a coverstitched seam and further has elastic reinforcement to allow for maximum stretch and wear. Coverstitching is executed with a coverstitch machine (such as the Janome CoverPro Model 900CP as previously described), and standard polyester/cotton blend thread is used for the coverstitched seam to provide a pleasing finish; such stitching also provides a finished look if outlines of garment 112 are visually perceived, during wearing, near the edges of outer clothing or when protruding slightly beyond the borders of other clothing.

Figure 6:
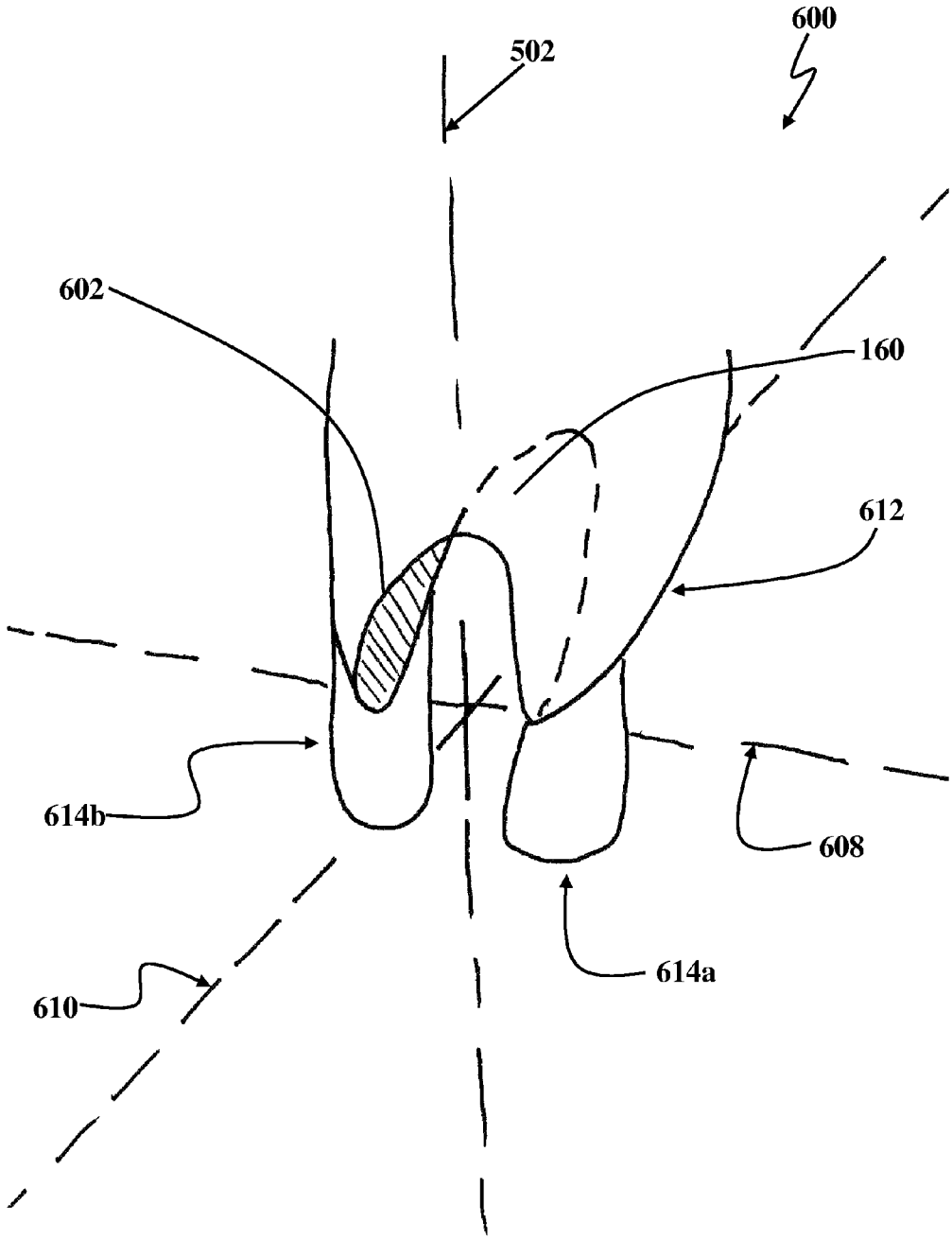
FIG. 6 shows a voiding aperture isometric view in a protective bodysuit.
Figure 7:
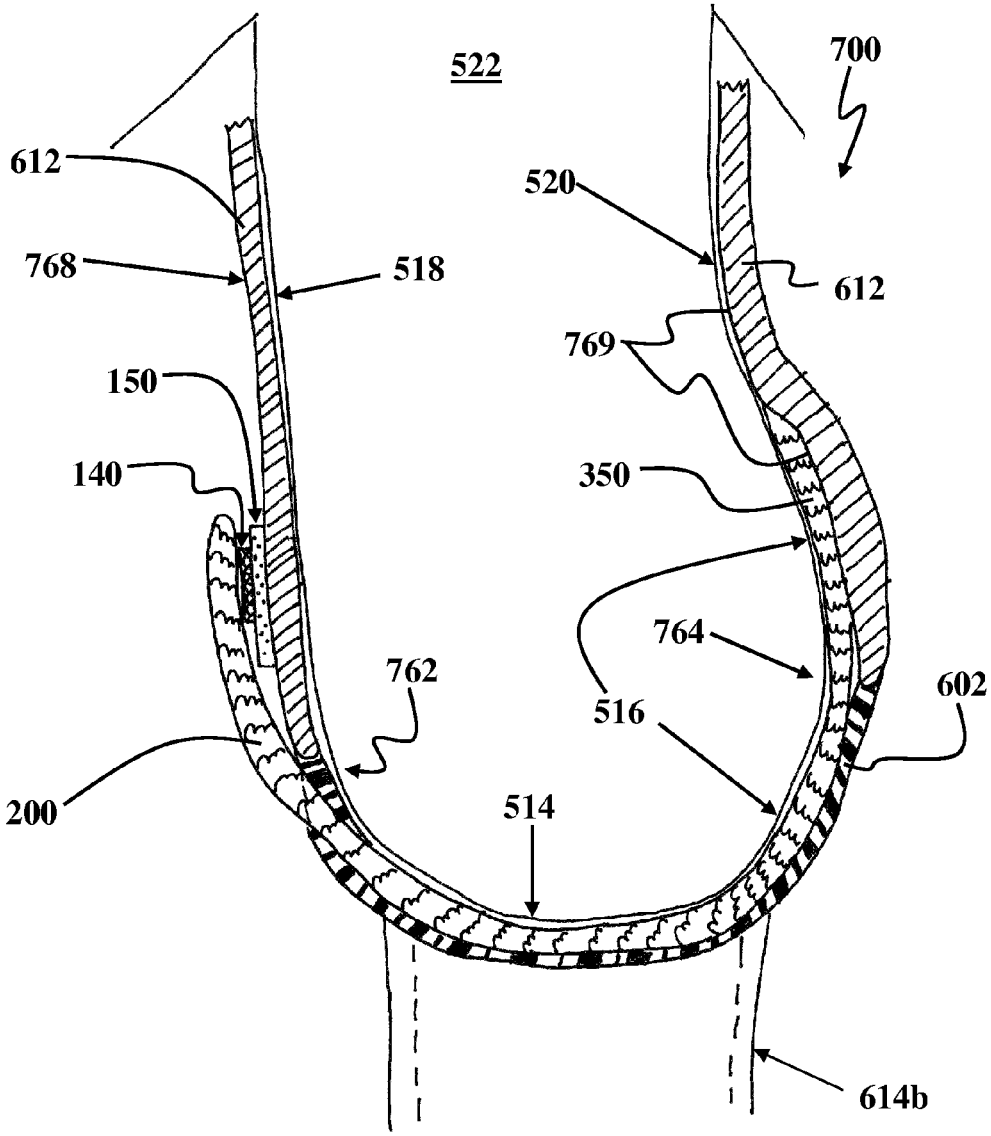
FIG. 7 presents a mesial plane voiding aperture cross-sectional view in a protective bodysuit.

The front (anterior side) of garment 112 is unlined, and pelvic girdle region 118 has an opening (voiding aperture 160) from the area of the pelvic bone in front (on the anterior side of the human body), through the groin area 514 (groin 514) between the legs, and partway up the buttock region in the back; details respective to voiding aperture 160 (sanitary voiding opening 160) are further defined in the discussion of FIGS. 6 and 7. Wrap-around pelvic girdle flap 200 (the anterior side of the elongated end portion of loincloth 350) is open in FIG. 1, such as is the case as the wearer pulls flap 200 back through groin area 514 to behind the body (to the posterior side of the body) to eliminate wastes (that is, for sanitary voiding). Wrap-around pelvic girdle flap 200 is "closed" in FIG. 2, representing positioning for normal (non-voiding) wear. FIG. 1 also shows a hook and loop closure system having fastening components 140 and 150. One such hook and loop closure system is provided with a VELCRO™ brand hook and loop closure material set available from Velcro USA, Inc. of 406 Brown Avenue, Manchester, N.H. The hook, or rough component (first fastening component 150), that is approximately about 2 inches vertically by about 3 inches wide (or, as previously described, about 2 inches wide by about 2 inches) is positioned just above the pelvic bone in the front of the wearer on the anterior surface of garment 112. The length of fastening component 150 allows for adjustability in the location of second fastening component 140 when positioned for closure to enable normal (non-voiding) wear. Such adjustability enables comfort in adjusting the compression of pelvic girdle flap 200 against the body surface and also facilitates adjustable use of garment 112 as a child grows physically. The loop (or soft) portion of hook and loop closure fastening components 140 and 150 is provided with second fastening component 140 (preferably about ¾" inch by about 2 inches, or, alternatively as reflecting either physical size or personal preference of the wearer, about ¾" inch by about 3 inches) that is positioned horizontally near the end of pelvic girdle flap 200. As FIG. 2 indicates, when flap 200 is "closed" against the anterior side of body sleeve 612 (see FIG. 6) of garment 112, the flap establishes a comfortable enclosure over the groin 514 for the wearer. If the wearer has an orthotic brace (not shown) that requires straps (not shown) to run from the front (anterior) to the back (posterior) of the wearer, the straps will not irritate the skin around the pelvic girdle region because the front (anterior) portion of the region, where the rubbing of the strap would be most prominent, is covered by inner thigh garment portions 130 and pelvic girdle flap 200.

Figure 3:
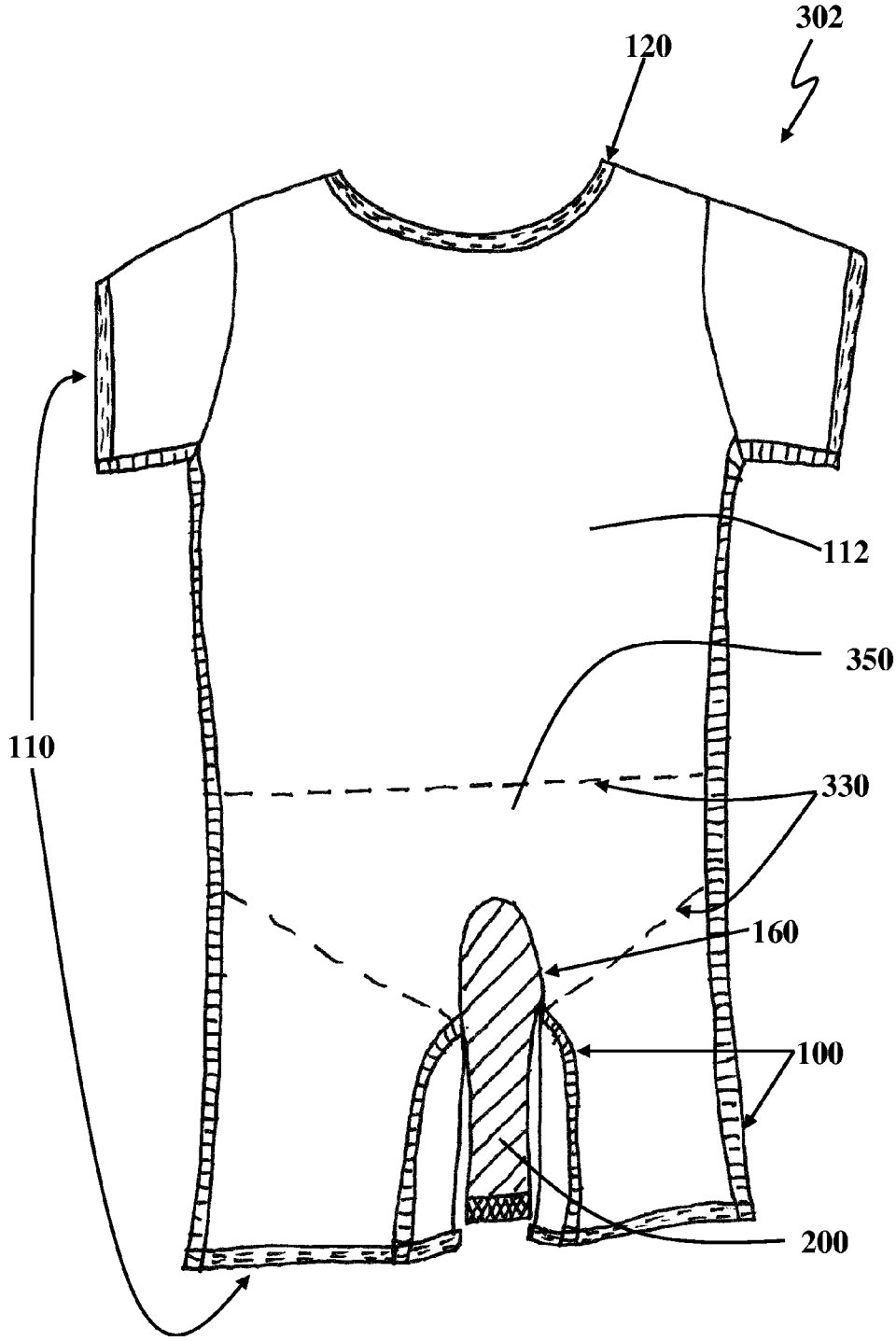
FIG. 3 provides a posterior view of a protective bodysuit when the bodysuit is open at the pelvic girdle area.
Figure 4:
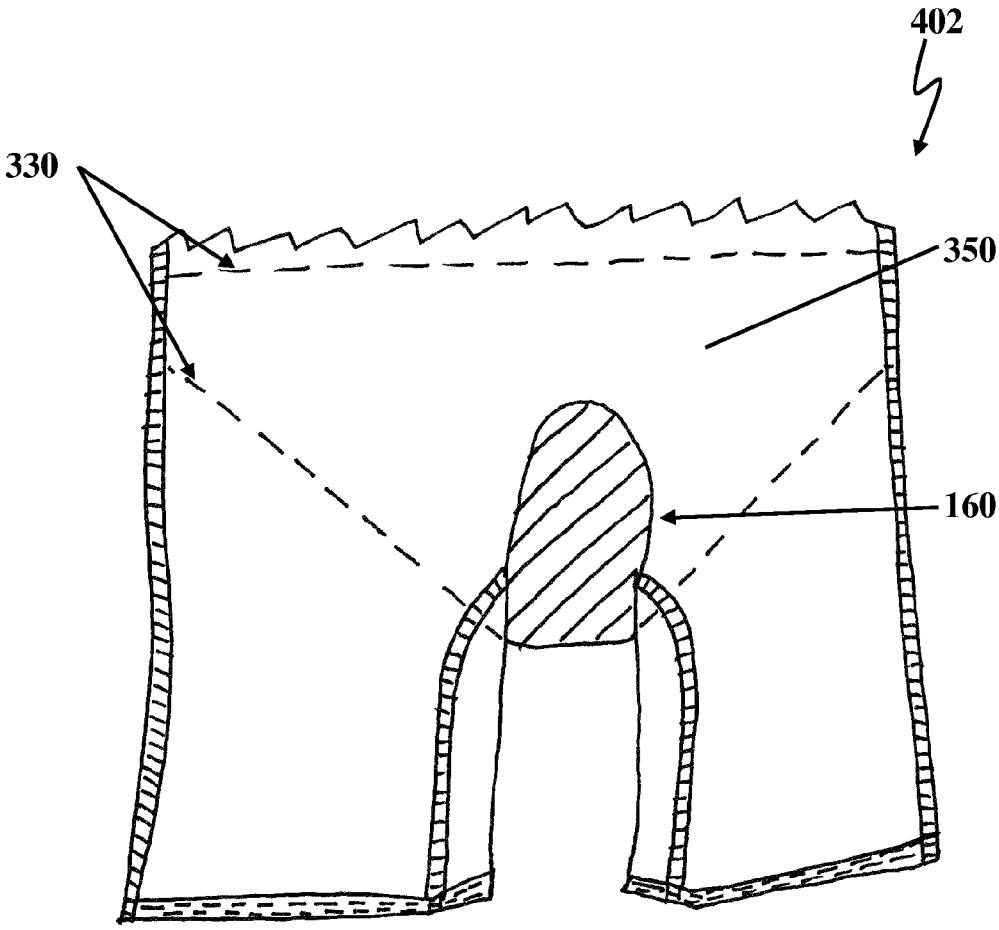
FIG. 4 provides a posterior view of a protective bodysuit when the bodysuit is closed at the pelvic girdle area.

FIGS. 3 and 4 both present posterior views 302, 402 of garment 112. FIG. 3 shows overall posterior view 302 of garment 112 with elongated loincloth portion 200 (pelvic girdle flap 200 of loincloth 350 unfastened and "pulled" downward along the posterior side of the wearer). FIG. 4 shows lower posterior view 402 of garment 112 when the pelvic girdle flap 200 of loincloth 350 (see FIG. 3) is fastened for normal (non-voiding) activity of the wearer (see FIG. 2 for the anterior view in this configuration). FIG. 3 reprises seams of FIG. 1, with two side seams and inner thigh seams 100 as external seams, (preferably finished and coverstitched) seams of the sleeve and leg openings 110 of garment 112, and (preferably coverstitched) seam 120 at the neck (again, with a note to preferable elastic reinforcement). FIG. 3 also shows the "lined portion" in the bottom half of garment 112 where the buttocks of the wearer is covered by a portion of loincloth 350. FIG. 3 also shows how this lining (portion of loincloth 350) extends to the edges of garment 112, down along the buttocks, and all the way to the bottom of the pelvic girdle flap with partial attachment using seams 330 (further detail in this regard is presented in the discussion of FIG. 8). FIG. 3 also shows a posterior portion of voiding aperture 160; as previously noted, details respective to the voiding aperture 160 are further defined in the discussion of FIGS. 6 and 7. To clarify, the posterior portion of loincloth 350 forms a lining for garment 112 that essentially fully covers the buttock region (closest to the skin); loincloth 350 then extends downward into an elongated end portion to provide pelvic girdle flap 200. The outermost "layer" of garment 112 has an opening (voiding aperture 160) to facilitate waste removal. In use in preparation for voiding, the wearer unfastens the hook and loop closure (fastener components 140 and 150) from the front (anterior side) of garment 112, and the wearer then pulls flap 200 behind (to the posterior side of the wearer's body) and upward to "open" or clear voiding aperture 160 in garment 112 for waste removal (sanitary voiding). The lining (posterior portion of loincloth 350 for body sleeve 612 of garment 112) preferably has overlocked edges and is attached to the inner surface of the lower portion of garment 112 by flat zig-zag stitching. Zig-zag stitching can be created by use of a standard sewing machine, and allows for stretch of garment 112. The stitching that runs diagonally along the lower buttock region only extends, in use of garment 112, halfway down to groin 514 so that garment 112 fully opens for waste removal (as further described in the discussion of FIG. 8).

Figure 5A:
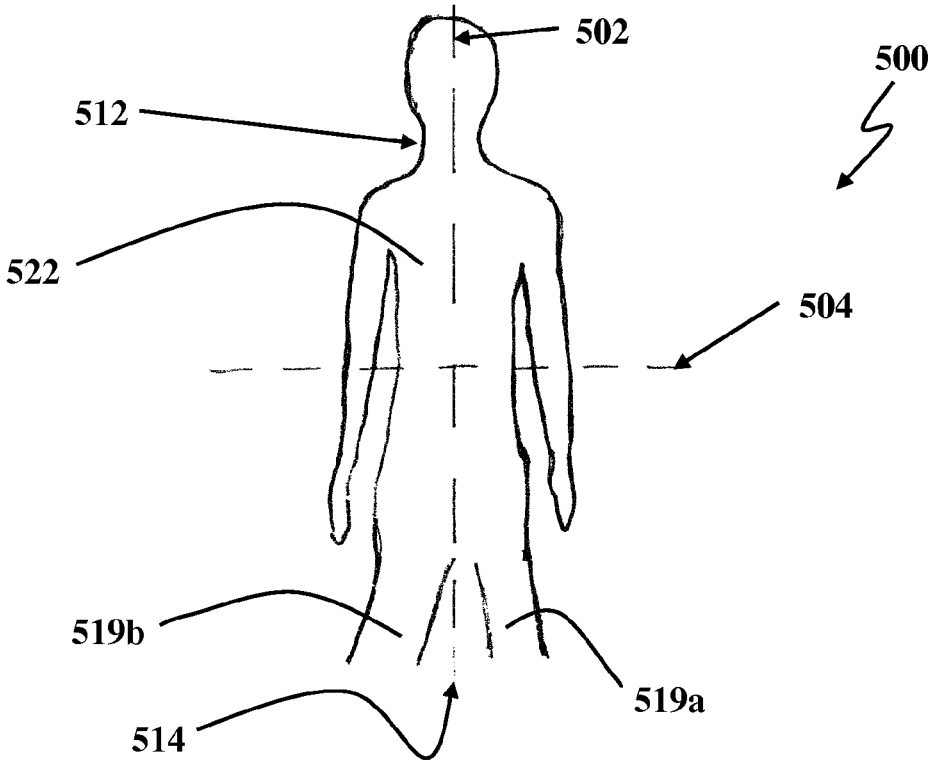
FIG. 5*a* depicts a transverse plane view of a human body.
Figure 5B:
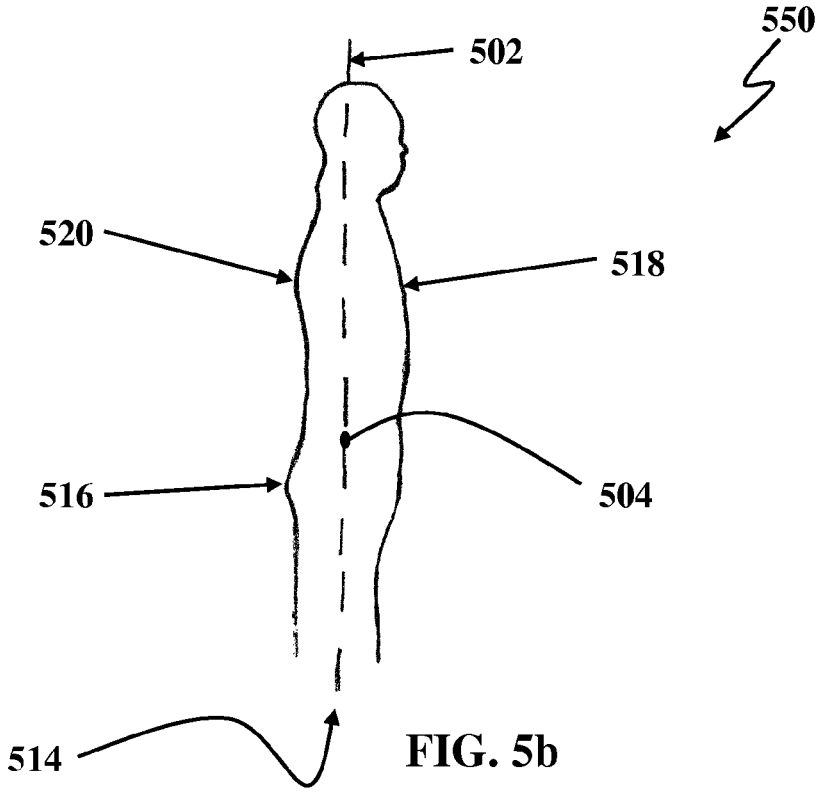
FIG. 5*b* depicts a mesial plane view of a human body.

Turning now to further detail in voiding aperture 160 (opening 160), loincloth 350, and the pelvic girdle flap 200 portion of loincloth 350, FIG. 5*a* depicts transverse plane view 500 of a human body in standing position, and FIG. 5*b* depicts mesial plane view 550 of a human body in standing position. In this regard, views 500 and 550 provide a set of geometric orientation axes and planes for further specification of voiding aperture 160 (opening 160), loincloth 350, and pelvic girdle flap 200 portions of loincloth 350. Even as the garment of the preferred embodiments is described with respect to planes and axes respective to a standing human, it is to be appreciated that the flexible material of the garment also provides efficacy for humans positioned in poses other than a standing position. The human figure of views 500 and 550 has neck 512, anterior body surface 518, posterior body surface 520, groin 514, torso 522 between neck 512 and groin 514, and buttocks 516 at a lower posterior portion of torso 522. First leg 519*a* and second leg 519*b* are also depicted. Geometric orienting references depicted in views 500 and 550 include vertical body axis 502 (relevant to the present invention in the portion of axis 502 between groin 514 and neck 512) and in horizontal body axis 504 (perpendicular to vertical body axis 502 at an upper extremity of buttocks 516). The transverse plane (body cross section of view 500) extends perpendicularly forward and backward from view 550 and contains axis 502 to divide posterior body surface 520 from anterior body surface 518; and the mesial plane (body cross section of view 550) extends perpendicularly forward and backward from view 500 and also contains axis 502. As shown in views 500 and 550, therefore, the mesial plane is perpendicular to horizontal body axis 504; and horizontal body axis 504 is contained in the transverse plane. Further consideration of views 500 and 550 indicate that the mesial plane and the transverse plane perpendicularly intersect at axis 502. Vertical body axis 502 (relevant to the present invention in the portion of axis 502 between groin 514 and neck 512) and horizontal body axis 504 (perpendicular to vertical body axis 502 at an upper extremity of buttocks 516) intersect, therefore, at a location where the transverse and mesial planes also intersect. The transverse plane extends forward and backward from view 550 and contains axis 502 to divide posterior body surface 520 from anterior body surface 518; and the mesial plane extends forward and backward from view 500 and also contains axis 502. The mesial and transverse planes, horizontal body axis 504, and vertical body axis 502 collectively provide a geometric framework for ready definition of details in voiding aperture 160 (opening 160), loincloth 350, and pelvic girdle flap 200 as a portion of loincloth 350 in FIGS. 6, 7, and 8.

FIG. 6 shows voiding aperture isometric view 600 in isometric perspective from an anterior viewing orientation. Vertical body axis 502 is reprised for geometric reference with groin transverse horizontal axis 608 in perpendicular orientation to axis 502 in the transverse plane and with groin mesial horizontal axis 610 in perpendicular orientation to axis 502 in the mesial plane. Perimeter 602 defines the boundary of voiding aperture 160. Body sleeve 612 (the portion of garment 112 without loincloth 350) clothes upper portions of first leg 519*a* and second leg 519*b* with first trouserette section 614*a* (that lightly compresses against the upper portion of first leg 519*a*) and second trouserette section 614*b* (that lightly compresses against the upper portion of second leg 519*b*). Body sleeve 612 also clothes torso 522 as shown in FIGS. 1-4. Voiding aperture 160 is defined in body sleeve 612 by closed perimeter 602. In this regard, closed perimeter 602 provides a sufficient circumference for aperture 160 to enable sanitary voiding. Closed perimeter 602 is essentially elliptical in form, is symmetrical about the mesial plane (the mesial plane contains axes 502 and 610), and has an elongated curvilinear axis (further detailed in the discussion of FIG. 7) that, in use, is generally contained in the mesial plane and is shaped to continuously contour along buttocks 516, groin 514, and a lower portion of anterior body surface 518.

FIG. 7 presents mesial plane voiding aperture cross-sectional view 700 with the curvilinear axis of perimeter 602 visualized along the surfaces of buttocks 516 (at a lower portion of posterior body surface 520), groin 514, and a lower portion of anterior body surface 518. Body sleeve 612 has inner posterior body sleeve surface 769 for lightly compressing against posterior body surface 520, outer anterior body sleeve surface 768 where body sleeve 612 clothes anterior body surface 518, and first fastening component 150 affixed to outer anterior body sleeve surface 768 at the fastening location where second fastening component 140 is affixed to pelvic girdle flap 200 (elongated end portion 200 of loincloth 350). Pelvic girdle flap 200 of loincloth 350 is shown in non-voiding use and smoothly shapes along buttocks 516, groin 514, and a lower portion of anterior body surface 518 to continuously contour thereover and cover the lower portions of torso 522. In this regard, loincloth 350 traverses through aperture 160 (as defined by perimeter 602) at location 764 and extends therefrom to provide an elongated end portion 200 fully covering groin 514 and anterior body surface 518 at locations within voiding aperture 160 up to location 762. Elongated end portion 200 then passes over body sleeve 612 at location 762 to cover outer anterior body sleeve surface 768 up to the general fastening location defined where first fastening component 150 is joined to second fastening component 140.

Figure 8:
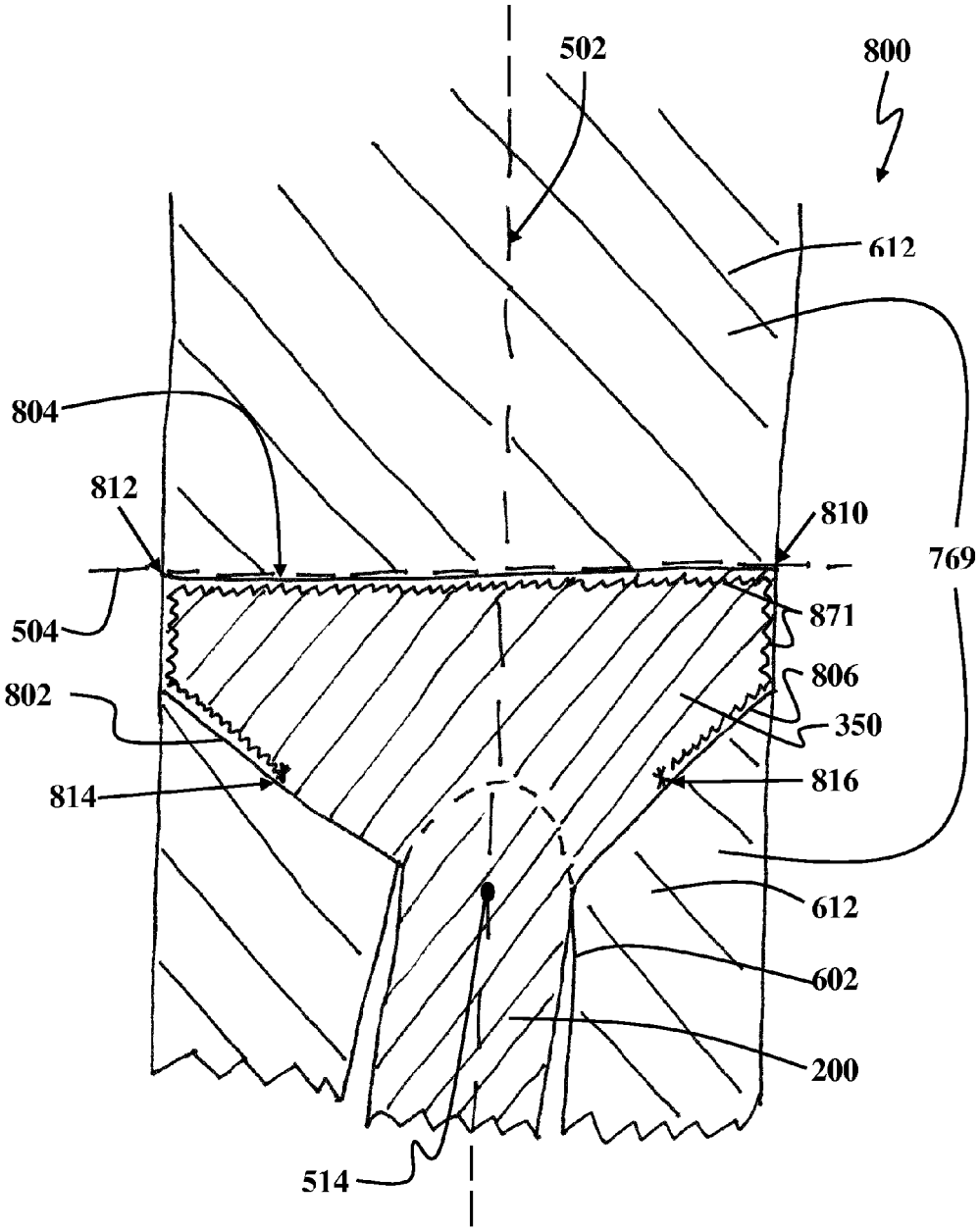
FIG. 8 presents a transverse plane loincloth cross-sectional view in a protective bodysuit where the view is from the transverse plane toward the inside of the posterior of the bodysuit.

Turning now to FIG. 8 where, in a view from the transverse plane toward the posterior inner surface of garment 112 (i.e., conceptually "viewing" from the inside of the human toward the posterior of the human to see the inside surface of the posterior side of the body sleeve), transverse plane loincloth cross-sectional view 800 shows shaping and attachment detail in loincloth 350 and inner posterior body sleeve surface 769, loincloth 350 bears against buttocks 516 and has side edges 802 and 806 respectively converging from below vertically-aligned side edge portions respective to first end 812 and second end 810 of upper edge 804 of loincloth 350 such that loincloth 350 essentially covers buttocks 516 before narrowing (to form the elongated portion designated as pelvic girdle flap 200) to traverse through the aperture defined by perimeter 602 in body sleeve 612. FIG. 8 reprises vertical body axis 502 and horizontal body axis 504 to show that upper edge 804 of loincloth 350 is proximate to horizontal axis 504 and that upper edge 804 essentially traverses completely across inner posterior body sleeve surface 769 (from end 812 to end 810) essentially perpendicularly through the mesial plane containing vertical body axis 502. Loincloth 350 is essentially symmetrical with respect to the mesial plane. Stitched attachment of loincloth 350 to inner posterior surface 769 of body sleeve 612 does not extend below locations 814 and 816 so that comfort in movement for the wearer is enabled (that is, so that the lower posterior portion of body sleeve 612 does not rub directly or chafe upon the buttocks when the wearer moves relative to body sleeve surface 769), so that aperture 160 will open for voiding, and so that the pelvic girdle flap 200 portion of loincloth 350 can be released from first fastening component 150 (by releasing second fastening component 140 from first fastening component 150) and pulled posteriorly to enable sanitary voiding through aperture 160. First side edge 802 is permanently attached to inside body sleeve surface 769 from first end 812 to first side edge interim location 814 (situated about halfway between groin 514 and first end, 812) using, in a preferred embodiment, stitching 871 to effect essentially continuous attachment; and second side edge 806 is permanently attached (also preferably via stitching 871) to inside body sleeve surface 769 from second end 810 to second side edge interim location 816 (situated about halfway between groin 514 and second end 810). In addition to minimization of chafing when the wearer moves relative to body sleeve surface 769 and enabling opening of aperture 160 for voiding, the lack of direct (stitched) attachment of loincloth 350 (in use) between location 814 and groin 514 (referentially indicated in FIG. 8) and also between location 816 and groin 514 provides efficacy in comfort in minimizing uncomfortable bunching of cloth material in body clefts of the lower torso.

A distance defined between first side edge interim location 814 and horizontal axis by a perpendicular line to horizontal axis 504 is less than any distance defined between closed perimeter 602 and horizontal axis 504, and a distance defined between second side edge interim location 816 and horizontal axis 504 by a perpendicular line to horizontal axis 504 is less than any distance defined between closed perimeter 602 and horizontal axis 504 so that loincloth 350 can be pulled to fully open aperture 160 for sanitary voiding.

The embodiments therefore provide an effective garment that protects against skin chafing when an orthotic brace is worn and also provides for mental comfort in a number of ways respective to modesty, facilitation of the ability of children and young adults to promptly use school sanitary facilities, minimization of visual perception of the bodysuit through outer clothing, and minimization of bunching of cloth in sensitive body areas. Especially in a young child or youth, all of these considerations relate to facilitating personal image, attentiveness in academics, mobility, and peer acceptance even as an orthotic brace needs to be worn to mitigate the effects of a disability.

As should be apparent, fully grown adults also benefit from the described efficacy of the embodiments in their social, professional, and physical experiences; as examples of application, adults in elder care or having extended bed rest benefit from the use of a bodysuit protective garment as described herein.

The examples and other embodiments described herein are exemplary and not intended to be limiting in describing the full scope of constructs, materials, and methods of this invention. Equivalent changes, modifications and variations of specific embodiments, materials, and methods may be made within the scope of the present invention, with substantially similar results.

What is claimed is:

1. A bodysuit for clothing of a human, said human having a neck, an anterior body surface, a posterior body surface, a groin, a torso between said neck and said groin, a buttocks at a lower posterior portion of said torso, a first leg and a second leg, and, for geometric orientation when in standing position, a vertical body axis defined from said groin to said neck, a horizontal body axis defined perpendicular to said vertical body axis at an upper extremity of said buttocks and disposed in a transverse plane dividing said posterior body surface from said anterior body surface, and a mesial plane containing said vertical body axis and also perpendicular to said horizontal body axis, said bodysuit comprising:

(a) a body sleeve for clothing said torso and upper portions of said first and second legs, said body sleeve having a first trouserette section for lightly compressing against said upper portion of said first leg, a second trouserette section for lightly compressing against said upper portion of said second leg, an inner posterior body sleeve surface for lightly compressing against said posterior body surface, an outer anterior body sleeve surface where said body sleeve clothes said anterior body surface, a voiding aperture defined in said body sleeve by a closed perimeter having sufficient circumference for enabling sanitary voiding, and a first fastening component affixed to said outer anterior body sleeve surface at a fastening location; and (b) a loincloth having an upper edge permanently attached to said inner posterior body sleeve surface, said loincloth having a second fastening component positioned for releasable joinder to said first fastening component;

wherein (c) said closed perimeter is essentially elliptical in form, is symmetrical about said mesial plane, and has an elongated curvilinear axis that, in use, is generally contained in said mesial plane and is shaped to continuously contour along said buttocks, said groin, and a lower portion of said anterior body surface;

(d) said upper edge has a first end and a second end, and is evenly attached to said inner posterior body sleeve surface from said first end to said second end;

(e) said upper edge is positioned to be, in use, proximate to said horizontal axis such that said upper edge essentially traverses completely across said inner posterior body sleeve surface perpendicularly through said mesial plane; and (f) said loincloth is symmetrical with respect to said mesial plane, is disposed in non-voiding use to smoothly shape along said groin and surfaces of said torso, and is dimensioned such that, in non-voiding use, said flap bears against said buttocks and has side edges that respectively converge from said first and second ends such that said flap essentially covers said buttocks, traverses through said aperture, extends therefrom to provide an elongated end portion fully covering said groin and said anterior body surface at locations within said voiding aperture, and further extends therefrom to said fastening location such that said second fastening component is positioned for releasable joinder to said first fastening component, and such that said loincloth can be released from said first fastening component and pulled posteriorly to enable sanitary voiding through said aperture.

2. The bodysuit of claim 1 wherein said body sleeve is constructed of stretch cotton knit cloth.

3. The bodysuit of claim 1 wherein, in use, a first side edge of said side edges is permanently attached to said inside body sleeve surface from said first end to a first side edge interim location situated about halfway between said groin and said first end, a second side edge of said side edges is permanently attached to said inside body sleeve surface from said second end to a second side edge interim location situated about halfway between said groin and said second end, a distance defined between said first side edge interim location and said horizontal axis by a perpendicular line to said horizontal axis is less than any distance defined between said closed perimeter and said horizontal axis along said posterior body surface, and a distance defined between said second side edge interim location and said horizontal axis by a perpendicular line to said horizontal axis is less than any distance defined between said closed perimeter and said horizontal axis along said posterior body surface.

4. The bodysuit of claim 1 wherein said first and second fastening components comprise hook and loop tape.

5. The bodysuit of claim 1 wherein said bodysuit is constructed of stretch cotton/spandex knit cloth.

6. The bodysuit of claim 1 wherein said body sleeve further comprises two arm sleeves.

7. The bodysuit of claim 1 wherein said body sleeve comprises at least one externally overlocked seam.

8. The bodysuit of claim 1 wherein arm-hole edges, a neck hole edge, and leg hole edges of said bodysuit are finished with coverstitched stitches.

9. The bodysuit of claim 5 wherein said first fastening component comprises an elongated hook and loop tape component disposed vertically so that said loincloth can be attached to provide comfortable compression against said groin.

10. The bodysuit of claim 1 wherein said upper edge is permanently attached to said inside body sleeve surface with a flat zigzag stitch.

11. The bodysuit of claim 3 wherein said upper edge and attached portions of said first side edge and said second side edge are all permanently attached to said inside body sleeve surface with a flat zigzag stitch.

12. The bodysuit of claim 3 wherein said first side edge is parallel to said mesial plane from said first end to said first side edge interim location, and said second side edge is parallel to said mesial plane from said second end to said second side edge interim location.

13. The bodysuit of claim 12 wherein said upper edge and attached portions of said first side edge and said second side edge are all permanently attached to said inside body sleeve surface with a flat zigzag stitch.

* * * * *